US006999695B2

(12) United States Patent
Ueda

(10) Patent No.: US 6,999,695 B2
(45) **Date of Patent: *Feb. 14, 2006**

(54) IMAGE FORMING APPARATUS HAVING INTERFACE TERMINALS

(75) Inventor: Motoshi Ueda, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/924,862

(22) Filed: Aug. 25, 2004

(65) Prior Publication Data

US 2005/0019054 A1 Jan. 27, 2005

Related U.S. Application Data

(63) Continuation of application No. 10/383,678, filed on Mar. 10, 2003, now Pat. No. 6,873,808.

(51) Int. Cl.
*G03G 15/00* (2006.01)
*H01R 13/60* (2006.01)

(52) U.S. Cl. ..... 399/90; 439/131; 439/528

(58) Field of Classification Search ..... 399/1, 399/9, 88, 90, 107; 439/131, 528, 652, 535
See application file for complete search history.

(56) References Cited

U.S. PATENT DOCUMENTS

| | | | |
|---|---|---|---|
| 5,893,662 | A | 4/1999 | Ito |
| 5,975,927 | A | 11/1999 | Giles |
| 6,067,425 | A | 5/2000 | Takarabe et al. |
| 6,081,678 | A | 6/2000 | Kato |
| 6,093,038 | A | 7/2000 | Chen et al. |
| 6,273,735 | B1 | 8/2001 | Johnson et al. |
| 6,456,496 | B1 | 9/2002 | Aldridge et al. |
| 6,527,566 | B1 | 3/2003 | Lambiaso |
| 6,567,273 | B1 | 5/2003 | Liu et al. |
| 6,676,420 | B1 | 1/2004 | Liu et al. |

FOREIGN PATENT DOCUMENTS

| | | |
|---|---|---|
| JP | 5-11366 U | 2/1993 |

*Primary Examiner*—Sandra L. Brase
(74) *Attorney, Agent, or Firm*—Foley & Lardner LLP

(57) ABSTRACT

An image forming apparatus has a main body containing an image forming unit which forms an image on a recording sheet by electrophotography, and a connector unit in which at least one external connection terminal is mounted. The external connection terminal is connected to a control unit which controls the image forming unit. The connector unit is supported on the main body so as to be rotationally movable to a position in which a plug can be inserted into the external connection terminal from the front of the main body, which corresponds to the operation side.

21 Claims, 3 Drawing Sheets

IMAGE FORMING APPARATUS HAVING INTERFACE TERMINALS

The present application is a continuation of U.S. application Ser. No. 10/383,678, filed Mar. 10, 2003, now U.S. Pat. No. 6,873,808 the entire contents of which are incorporated herein by reference.

BACKGROUND OF THE INVENTION

1. Field of the Invention

The present invention relates to an image forming apparatus in which the direction in which external connection terminals are inserted can be changed.

2. Description of the Related Art

One form of an image forming apparatus is a multifunction machine having a combination of functions of, for example, a copier, a printer, a scanner, and a facsimile machine. The multifunction machine has various connectors because different data communication methods may be used for the respective functions. The external connection terminals are provided on the rear surface of the main body so that cables inserted into the external connection terminals using plugs will not obstruct users. In this case, the plugs and cables, inserted into the external connection terminals, extend perpendicularly to an inserting section. Further, the plugs are inserted into the external connection terminals. As a result, the multifunction machine is installed so as to provide sufficient space behind it.

Furthermore, the multifunction machine is changed to multifunctional and the latest conditions by expanding and updating its functions. In such a case, a portable operation terminal such as a notebook-type personal computer (notebook PC) is connected to the multifunction machine via one of the external connection terminals to change the connections according to the functions or to update systems controlling the respective functions or change set values. Also in the case of periodic maintenance, the operation terminal is connected to the multifunction machine via the external connection terminal.

However, if the operation terminal is temporarily connected to the multifunction machine, it is difficult to approach and operate the external connection terminal because it is provided on the rear surface of the multifunction machine. Moreover, it is contemplated that the multifunction machine may be moved to simplify the connection to the external connection terminal. However, the multifunction machine, provided with the multiple functions, is often large and heavy. Further, care must be taken to prevent the connected plug from slipping out of the external connection terminal. Therefore, it is difficult to connect the plug to the external connection terminal.

BRIEF SUMMARY OF THE INVENTION

An image forming apparatus according to an aspect of the present invention is provided with a connector unit that can be moved and carries external connection terminals so that the plugs can be allowed to easily insert into the external connection terminals by moving the connector unit.

The image forming apparatus comprises a main body containing an image forming unit which forms an image on a recording sheet by electrophotography, and a connector unit in which at least one external connection terminal is mounted, the external connection terminal being connected to a control unit which controls the image forming unit, the connector unit being supported on the main body so as to be rotationally movable to a position in which a plug can be inserted into the external connection terminal from a front of the main body corresponding to an operation side.

Objects and advantages of the invention will become apparent from the description which follows, or may be learned by practice of the invention.

BRIEF DESCRIPTION OF THE DRAWING

The accompanying drawings illustrate embodiments of the invention, and together with the general description given above and the detailed description given below, serve to explain the principles of the invention.

DETAILED DESCRIPTION OF THE INVENTION

Figure 1:
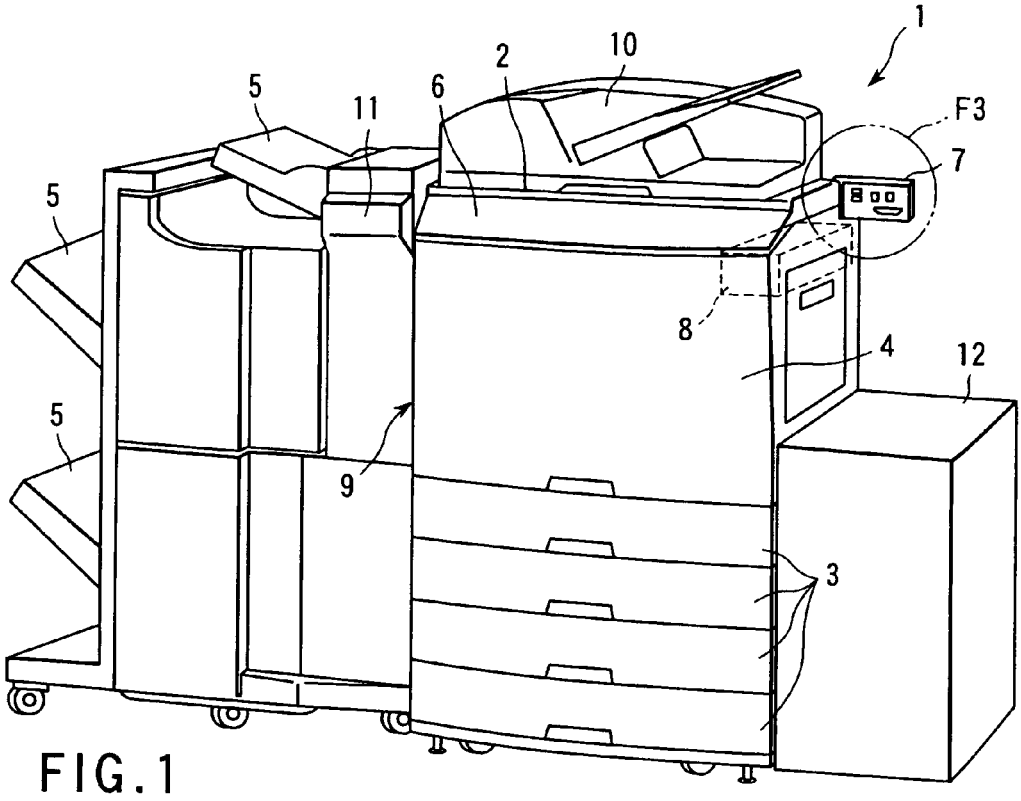
FIG. 1 is a perspective view showing a multifunction machine of a first embodiment according to the present invention.

A first embodiment according to the present invention will be described with reference to FIGS. 1 to 4. A multifunction machine 1, shown in FIG. 1, is one form of an image forming apparatus provided with the functions of a copier, a scanner, and a printer. The multifunction machine 1 may be further provided with the functions of a facsimile machine. As shown in FIG. 1, the multifunction machine 1 comprises an image reading section 2, a recording sheet cassettes 3, an image forming unit 4, a discharge tray 5, an operation panel 6, a connector unit 7, and a control unit 8, all these components being provided in a main body 9. In the present embodiment, the multifunction machine 1 also comprises an automatic original feeding device 10, a finisher 11, and a large capacity recording sheet feeder 12 all arranged around the periphery of the main body 9 as optional equipments.

Figure 2:
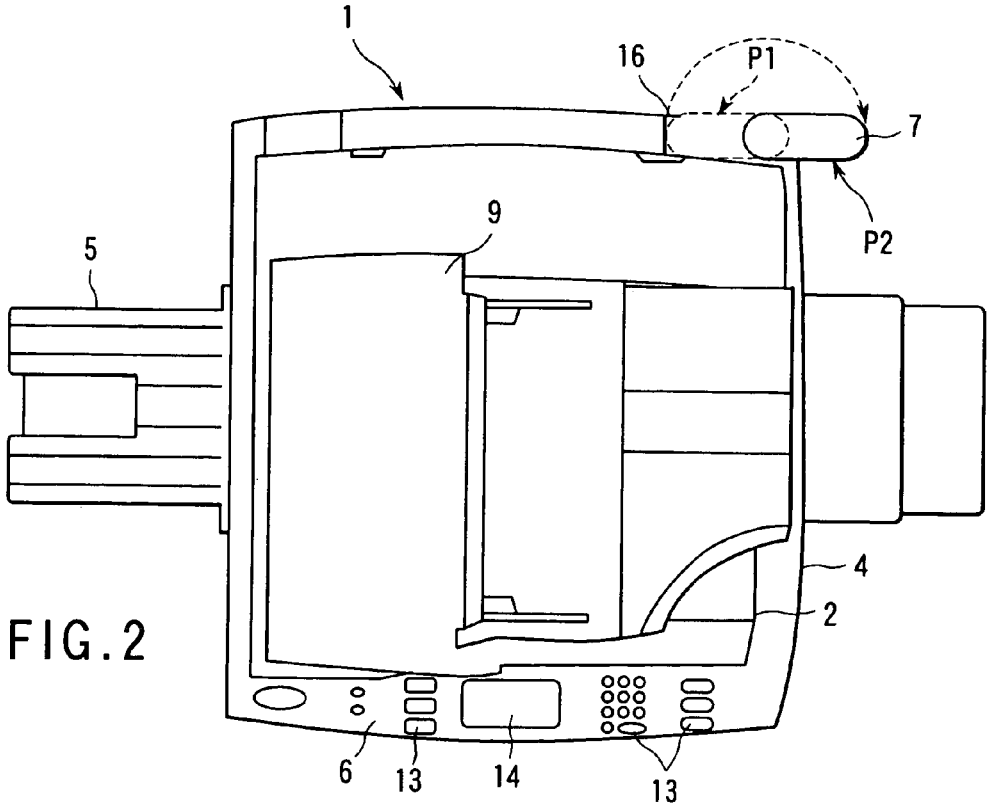
FIG. 2 is a plan view showing the multifunction machine in FIG. 1.

The image reading section 2 is arranged above the image forming unit 4. The automatic original feeding device 10 is mounted on the image reading section 2 instead of a cover to automatically supply original sheets on each of which an image to be read is drawn, to the image reading section 2 one by one. A plurality of recording sheet cassettes 3 is arranged under the image forming unit 4. Recording sheets of different sizes or the same size may be stocked in each of the recording sheet cassettes 3. The large capacity recording sheet feeder 12 is installed at the side of the image forming unit 4 to store a large amount of recording sheets of a type that is likely to be consumed in large quantities. The image forming unit 4 forms an image read by the image reading section 2, on a recording sheet by electrophotography. The discharge tray 5 is provided to receive recording sheets discharged from the image forming unit 4. The discharge tray 5 may be attached to the side of image forming unit 4 as shown in FIG. 2 or may be provided downstream of the finisher 11. The finisher 11 is provided between the image forming unit 4 and the discharge tray 5 to sort, staple, and punch recording sheets discharged by the image forming unit 4. The operation panel 6 is arranged on the image forming unit 4 and in the front side of it. As shown in FIG. 2, an input button 13 and a display 14 are provided on the operation panel 6. The display 14 shows the conditions of the multifunction machine 1, operation guidance, instructions, and information together with related illustrations.

The control unit 8 is connected to each of the image reading section 2, the recording sheet cassettes 3, the image forming unit 4, the operation panel 6, external connection terminals 17*a*, 17*b*, and 17*c* in the connector unit 7, external connection terminals located at the bottom of rear surface of the main body, the automatic original feeding device 10, the finisher 11, and the large capacity recording sheet feeder 12.

The external connection terminals, which are required to use the machine as a printer, a scanner, or a facsimile machine, are provided at the bottom of rear surface of the main body 9. The external connection terminals are provided to conform to different specifications so as to correspond to communication methods and the shapes of connectors. The external connection terminals include, for example, a serial port, a USB (Universal Serial Bus) port, a LAN (Local Area Network) port, a telephone line port, an IEEE 1394 port, and a parallel port.

Figure 4:
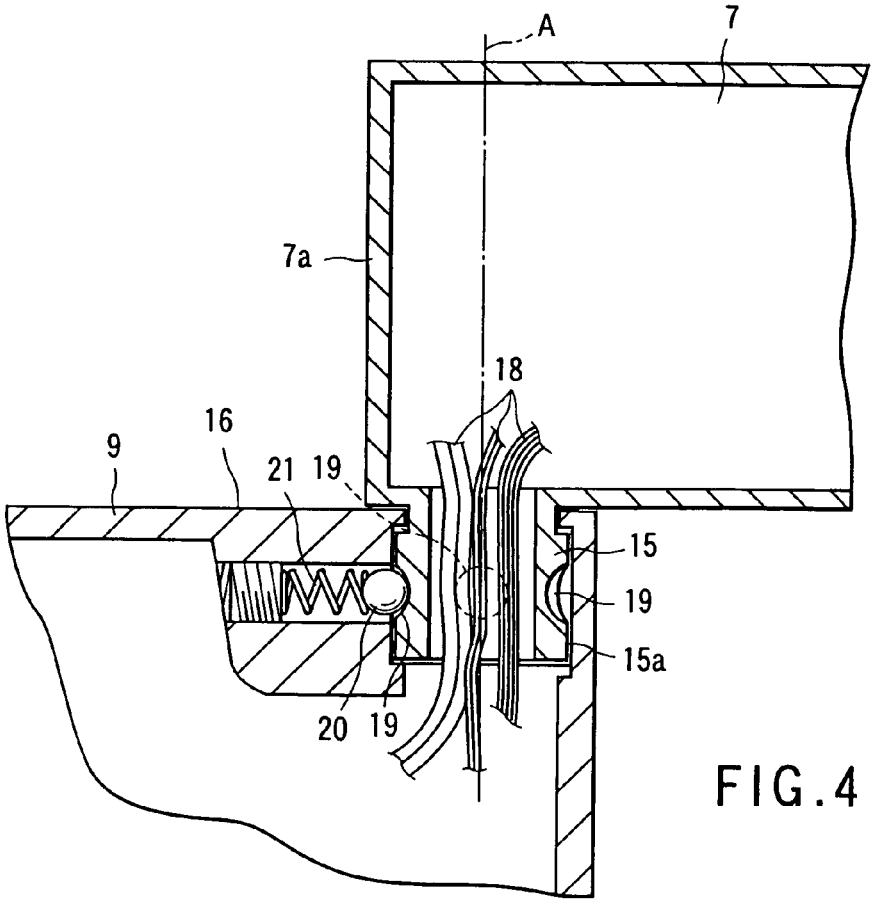
FIG. 4 is a view showing the structure of a support section for a connector unit in FIG. 3.

In addition to these connectors, the multifunction machine 1 is provided with the connector unit 7 at the upper rear potion of the main body 9. The connector unit 7 comprises a rotational shaft 15 as shown in FIG. 4. The connector unit 7 is connected to the main body 9 via the rotational shaft 15. A central axis A of the rotational shaft 15 is provided to extend in a vertical direction. The connector unit 7 rotationally moves in a horizontal direction along an arrow r1. The connector unit 7 rotationally moves between a stowed position P1 in which it is stowed in a housing section 16 provided in the main body 9 and a deployed position P2 in which it projects from the main body 9 so as to be accessed from the front of the multifunction machine 1 corresponding to the operation side of the machine. In the stowed position P1, the connector unit 7 may protrude from the housing section 16.

Figure 3:
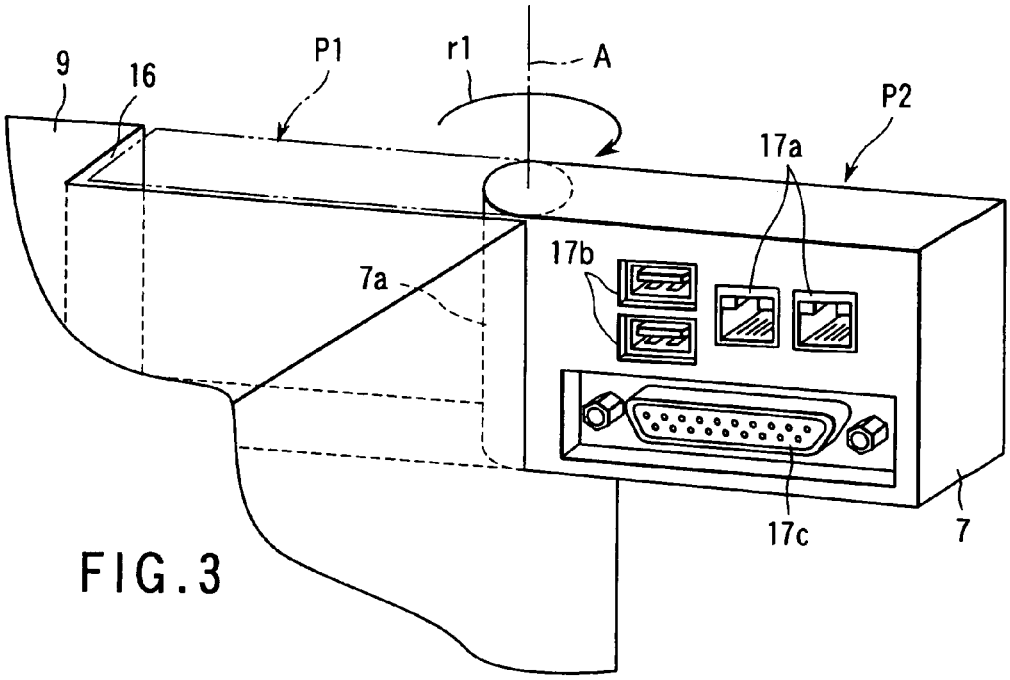
FIG. 3 is a perspective view showing a part F3 in FIG. 1.

The connector unit 7 is provided with the external connection terminals 17*a*, 17*b*, and 17*c*, which are similar to the external connection terminals provided at the bottom of rear surface of the main body 9. By way of example, in the present embodiment, the connector unit 7 is provided with two LAN ports 17*a*, two USB ports 17*b*, and one serial port 17*c* as shown in FIG. 3. The external connection terminals 17*a*, 17*b*, and 17 are arranged so as to face toward the front (operation panel 6) of the multifunction machine 1 when the connector unit 7 is in its deployed position P2.

As shown in FIG. 4, the rotational shaft 15 is hollow so that cables 18 joining the external connection terminals 17*a*, 17*b*, and 17*c* to the control unit 8 of the multifunction machine 1 are passed through the rotational shaft 15. A rotary coupler may be provided instead of passing the cables through the shaft 15.

At the connection between the connector unit 7 and the main body 9, a recess 19 is formed in an outer peripheral surface 15*a* of the rotational shaft 15, with a ball 20 and a spring 21 provided on the multifunction machine 1 side. The ball 20 is pressed against the recess 19 by the spring 21. The recess 19 is positioned to fit over the ball 20 when the connector unit 7 is in its stowed position P1 and deployed position P2. This constitutes what is called ball latch mechanism. The ball latch mechanism is arranged where the connector unit 7 is firmly fixed both in its deployed position P2 and in its stowed position P1.

In the present embodiment, the ball latch mechanism is provided in the rotational shaft 15. However, it may have only to be provided where the connector unit 7 and the main body 9 pass each other. For example, the recess 19 may be formed in a outer side surface 7*a* of the connector unit 7 which is closer to the center of rotational movement, with the ball 20 and the spring 21 provided opposite the recess 19. Alternatively, the recess 19 may be formed in the main body 9, with the ball 20 and the spring 21 provided opposite the recess 19. Alternatively, a groove may be formed parallel to the central axis A in place of the recess 19.

A multifunction machine 1 of a second embodiment according to the present invention will be described with reference to FIG. 5. The same arrangements as those of the multifunction machine 1 of the first embodiment are denoted by the same reference numerals. Their description is thus omitted.

Figure 5:
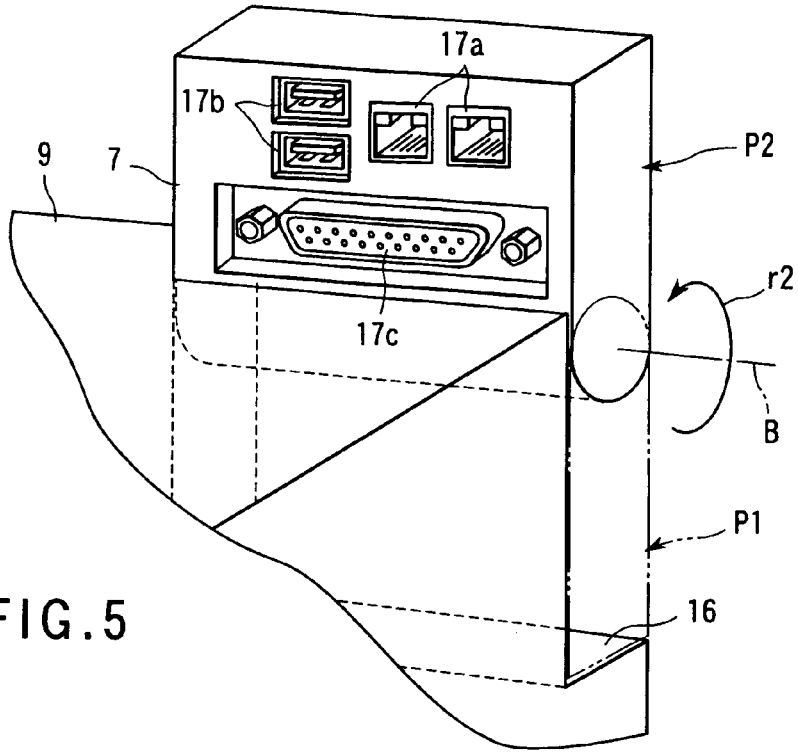
FIG. 5 is a perspective view showing that part of a multifunction machine of a second embodiment according to the present invention which corresponds to the part F3 in FIG. 1.

As shown in FIG. 5, the connector unit 7 rotationally moves along an arrow r2 around an axis B extending leftward from the multifunction machine 1. Accordingly, when the connector unit 7 is rotationally moved from its stowed position P1 to deployed position P2, it projects upward from the main body 9. Further, the other arrangements are the same as those of the first embodiment except for the rotationally moving direction of the connector unit 7. Their description is thus omitted.

With the connector unit 7 according to the first and second embodiments, the external connection terminals 17*a*, 17*b*, and 17*c* face toward the rear of the main body 9 in the stowed position P1 and toward the front of the multifunction machine 1 in the deployed position P2.

A multifunction machine 1 of a third embodiment according to the present invention will be described with reference to FIG. 6. The same arrangements as those of the multifunction machines 1 of the first and second embodiments are denoted by the same reference numerals. Their description is thus omitted. Further, the third embodiment is the same as the first and second embodiments except for the rotationally moving direction of the connector unit 7. The description of the other arrangements is thus omitted.

Figure 6:
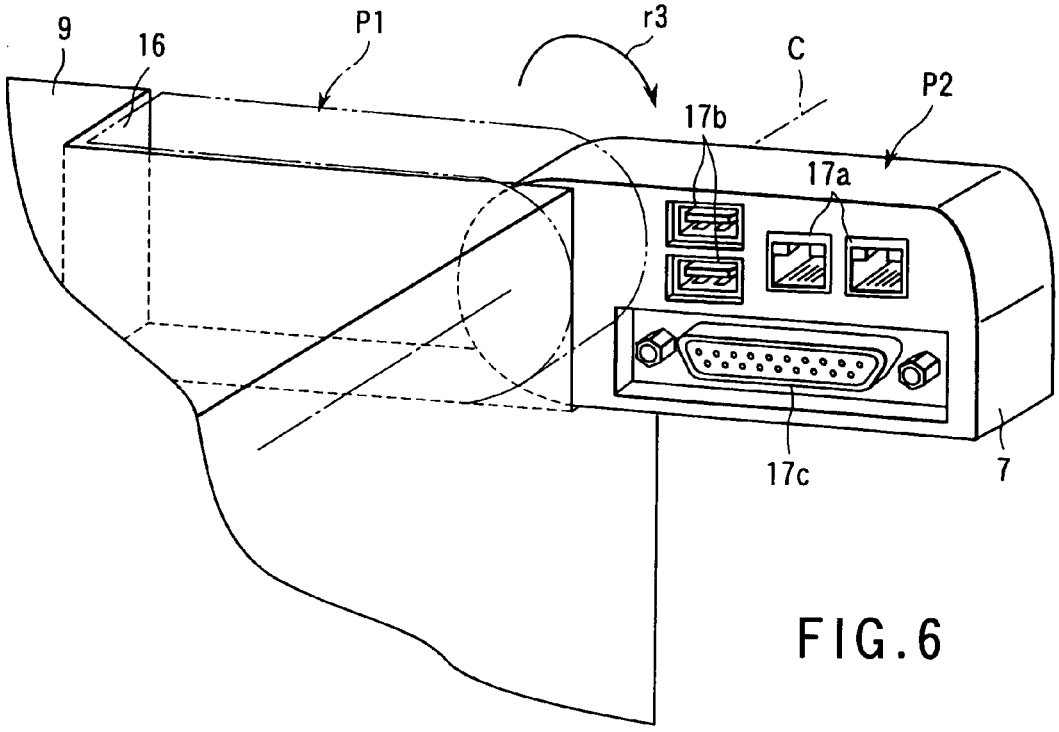
FIG. 6 is a perspective view showing that part of a multifunction machine of a third embodiment according to the present invention which corresponds to the part F3 in FIG. 1.

As shown in FIG. 6, the connector unit 7 rotationally moves around an axis extending from front to rear of the multifunction machine 1. The external connection terminals 17*a*, 17*b*, and 17*c* are fitted so as to face toward the front of the machine. The housing section 16 is provided in the rear right upper corner of the main body 9 so as to extend leftward (toward the inside of the main body 9). Accordingly, in the stowed position P1, the external connection terminals 17*a*, 17*b*, and 17*c* face the main body 9 and are hidden behind it. When the connector unit 7 is rotationally moved toward the deployed position P2 along an arrow r3, the external connection terminals 17*a*, 17*b*, and 17*c* appear. Then, plugs can be inserted into these external connection terminals. The external connection terminals 17*a*, 17*b*, and 17*c* in the connector unit 7 always face toward the front of the main body 9. Consequently, even when the connector unit 7 rises perpendicularly to the main body 9, plugs can be inserted into the external connection terminals 17*a*, 17*b*, and 17*c*. Therefore, the ball latch mechanism may be provided so that the connector unit 7 can be fixed even when it rises perpendicularly. The position in which the connector unit 7 rises perpendicularly may be used as the deployed position P2.

With the multifunction machines 1 of the first and second embodiments, to allow the connector unit 7 to rotationally move from its stowed position P1 to deployed position P2, a space must be provided behind the main body. In contrast, with the multifunction machine 1 of the third embodiment, the connector unit 7 rotationally moves along the rear surface of the main body 9. It is thus unnecessary to provide a space behind the main body 9. Further, the connector unit 7 rotationally moves around the axis C, extending from front to rear of the main body 9, and its external connection terminals 17*a*, 17*b*, and 17*c* face toward the front of the main body 9. Therefore, when plugs are inserted into the external connection terminals 17*a*, 17*b*, and 17*c*, the connector unit 7 can be prevented from moving rearward without any ball latch mechanisms.

In the multifunction machines 1 of the first, second, and third embodiments, the rotationally moving connector unit 7 comprises the external connection terminals 17*a*, 17*b*, and 17*c*. Thus, by rotationally moving the connector unit 7 to its deployed position P2, plugs can be inserted into the external connection terminals 17*a*, 17*b*, and 17*c* from the front of the main body 9. Accordingly, when a notebook PC is temporarily connected to the multifunction machine 1 in order to expand any function, change any setting, or perform a maintenance operation, the external connection terminals 17*a*, 17*b*, and 17*c* of the connector unit 7 can be used to easily accomplish this connection. Further, if a user utilizes a notebook PC that is not connected to a communication network to which the multifunction machine 1 is connected, the user can temporarily and easily connect his or her notebook PC to the multifunction machine 1 to use it.

Further, in addition to the external connection terminals 17*a*, 17*b*, and 17*c*, a power supply connector may be provided in the connector unit 7. The power supply unit can supply power to a temporarily connected notebook PC. This avoids troubling the user about finding a receptacle for a power cord around the periphery of the multifunction machine 1 to avoid the battery in the notebook PC going dead.

According to each embodiment, the connector unit 7 is provided in the rear upper corner of the main body 9. However, it may be provided in the rear corner of bottom of the main body 9. In this case, those external connection terminals into which plugs are always inserted may be mounted in the connector unit 7 altogether. By allowing the connector unit 7 to be fixed by being rotationally moved in a desired direction, the degree of freedom to lay out the multifunction machine 1 is increased. This also facilitates connection or reconnection of the multifunction machine 1 to peripheral equipment. Alternatively, the connector unit 7 may be provided in a front corner of the main body 9.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the inventive as defined by the appended claims and equivalents thereof.

What is claimed is:

1. An image forming apparatus comprising:

a main body containing an image forming unit which forms an image on a recording sheet by electro-photography;

a connector unit in which at least one external connection terminal is mounted, the external connection terminal being connected to a control unit which controls the image forming unit, the connector unit being supported on the main body so as to be rotationally movable in a direction in which an insertion angle of a plug with the main body is changed, the plug being inserted into external connection terminal at the insertion angle; and a hollow rotating shaft which connects the main body and the connector unit together and through which wiring is passed, the wiring connecting the control unit and the external connection terminal together.

2. An image forming apparatus according to claim 1, wherein the connector unit rotationally moves from a stowed position at which the connector unit is stowed in the main body and a deployed position at which the connector unit projects from the main body so that the external connection terminal can be accessed from the front of the main body corresponding to an operation side.

3. An image forming apparatus according to claim 1, wherein the connector unit rotationally moves around a vertically extending axis.

4. An image forming apparatus according to claim 1, wherein the connector unit rotationally moves around an axis extending from right to left of the main body when an operation side of the main body corresponds to the front of the main body.

5. An image forming apparatus according to claim 1, wherein the connector unit rotationally moves around an axis extending from front to rear of the main body when an operation side of the main body corresponds to the front of the main body.

6. An image forming apparatus according to claim 1, wherein:

the rotating shaft is fixed to the connector unit and has a recess in an outer peripheral surface, and the main body comprises a locking member which is fitted in the recess and an elastic member which presses the locking member against the recess.

7. An image forming apparatus according to claim 6, wherein the recess is formed at a position at which the locking member is fitted in the recess when the connector unit is in the stowed position and the deployed position.

8. An image forming apparatus according to claim 1, wherein the main body has a housing section in which the connector unit is stowed when the connector unit is in the stowed position.

9. An image forming apparatus according to claim 8, wherein the connector unit protrudes from the housing when the connector unit is in the stowed position.

10. An image forming apparatus according to claim 1, further comprising:

an image reading section provided in upper portion of the main body:

an operation panel provided in the front of the main body;

a recording sheet cassette in which recording sheets to be supplied to the image forming unit are stored; and a discharge tray which receives a recording sheet on which an image is formed by the image forming unit.

11. An image forming apparatus comprising:

a main body containing an image forming unit which forms an image on a recording sheet by electro-photography; and a connector unit in which at least one external connection terminal is mounted, the external connection terminal being connected to a control unit which controls the image forming unit, the connector unit being supported on the main body so as to be rotationally movable to a position in which a plug can be inserted into the external connection terminal from a front of the main body corresponding to an operation side, wherein the connector unit rotationally moves from a stowed position at which the connector unit is stowed in the main body and a deployed position at which the connector unit projects from the main body so that the external connection terminal can be accessed from the front of the main body corresponding to the operation side, wherein said at least one connection terminal of the connector unit is directed rearward when the connector unit is at the stowed position and is directed frontward when the connector unit is at the deployed position.

12. An image forming apparatus according to claim 11, wherein the connector unit rotationally moves around a vertically extending axis.

13. An image forming apparatus according to claim 11, wherein:

a rotating shaft is fixed to the connector unit and has a recess in an outer peripheral surface, and the main body comprises a locking member which is fitted in the recess and an elastic member which presses the locking member against the recess.

14. An image forming apparatus according to claim 13, wherein the recess is formed at a position at which the locking member is fitted in the recess when the connector unit is in the stowed position and the deployed position.

15. An image forming apparatus according to claim 11, wherein the main body has a housing section in which the connector unit is stowed when the connector unit is in the stowed position.

16. An image forming apparatus according to claim 15, wherein the connector unit protrudes from the housing when the connector unit is in the stowed position.

17. An image forming apparatus comprising:

a main body containing an image forming unit which forms an image on a recording sheet by electro-photography; and a connector unit in which at least one external connection terminal is mounted, the external connection terminal being connected to a control unit which controls the image forming unit, the connector unit being supported on the main body so as to be rotationally movable to a position in which a plug can be inserted into the external connection terminal from a front of the main body corresponding to an operation side, wherein the connector unit rotationally moves from a stowed position at which the connector unit is stowed in the main body and a deployed position at which the connector unit projects from the main body so that the external connection terminal can be accessed from the front of the main body corresponding to the operation side, wherein said at least one connection terminal of the connector unit is directed rearward when the connector unit is at the stowed position and is directed frontward when the connector unit is at the deployed position, wherein the connector unit rotationally moves around an axis extending from right to left of the main body when the operation side corresponds to the front of the main body.

18. An image forming apparatus according to claim 17, wherein:

a rotating shaft is fixed to the connector unit and has a recess in an outer peripheral surface, and the main body comprises a locking member which is fitted in the recess and an elastic member which presses the locking member against the recess.

19. An image forming apparatus according to claim 18, wherein the recess is formed at a position at which the locking member is fitted in the recess when the connector unit is in the stowed position and the deployed position.

20. An image forming apparatus according to claim 17, wherein the main body has a housing section in which the connector unit is stowed when the connector unit is in the stowed position.

21. An image forming apparatus according to claim 20, wherein the connector unit protrudes from the housing when the connector unit is in the stowed position.

* * * * *